US006617776B1

(12) United States Patent
Ide et al.

(10) Patent No.: US 6,617,776 B1
(45) Date of Patent: Sep. 9, 2003

(54) COLOR PICTURE TUBE SHADOW MASK MATERIAL

(75) Inventors: Tsuneyuki Ide, Yamaguchi-ken (JP); Takahiko Miyazaki, Yamaguchi-ken (JP); Susumu Sigemasa, Yamaguchi-ken (JP); Yasuo Tahara, Yamaguchi-ken (JP); Hironao Okayama, Yamaguchi (JP)

(73) Assignee: Toyo Kohan Co., Ltd., Tokyo (JP)

( * ) Notice: Subject to any disclaimer, the term of this patent is extended or adjusted under 35 U.S.C. 154(b) by 0 days.

(21) Appl. No.: 09/869,201

(22) PCT Filed: Dec. 24, 1999

(86) PCT No.: PCT/JP99/07266

§ 371 (c)(1),
(2), (4) Date: Jun. 25, 2001

(87) PCT Pub. No.: WO00/39354

PCT Pub. Date: Jul. 6, 2000

(30) Foreign Application Priority Data

Dec. 25, 1998 (JP) ..... 10-368800

(51) Int. Cl.[7] ..... H01J 29/80

(52) U.S. Cl. ..... 313/402; 313/407; 313/408

(58) Field of Search ..... 313/402, 403, 313/404, 405, 406, 407, 408

(56) References Cited

U.S. PATENT DOCUMENTS 2,625,734 A * 1/1953 Law ..... 445/4

FOREIGN PATENT DOCUMENTS

| | | | | |
|---|---|---|---|---|
| JP | 64-025953 | * | 1/1989 | ..... C22C/38/54 |
| JP | 10-219396 | | 2/1997 | |
| JP | 10-219397 | | 8/1998 | |

* cited by examiner

*Primary Examiner*—Nimeshkumar D. Patel
*Assistant Examiner*—Jason Phinney
(74) *Attorney, Agent, or Firm*—Browdy and Neimark, PLLC

(57) ABSTRACT

It is an object of this invention to provide a shadow mask material for use in a color picture tube excellent in tensile strength and excellent in high temperature creep strength, a shadow mask and a picture tube incorporating the same. For this purpose, the shadow mask material according to this invention uses a low carbon alloy steel sheet containing from 0.05 to 2.5% by weight of Cu and 0.001 to 0.4% by weight of P, or from 0.05 to 2.5% by weight of Cu, from 0.001 to 0.4% by weight of P and from 0.01 to 1.75% by weight of Ni.

6 Claims, No Drawings

COLOR PICTURE TUBE SHADOW MASK MATERIAL

REFERENCE TO RELATED APPLICATIONS

The present application is the national stage under 35 U.S.C. §371 of international application PCT/JP99/07266, filed Dec. 14, 1999 which designated the United States, and which application was not published in the English language.

1. Technical Field

This invention concerns a shadow mask material for use in a color picture tube, a shadow mask and a color picture tube incorporating the same. More specifically it relates to a mask material for use in a color picture tube having excellent tensile strength and high temperature creep strength, a shadow mask and a color picture tube incorporating the same.

2. Background Art

In recent years, in shadow mask type color picture tubes, so-called flat face cathode ray tubes have been adopted, which are attached by welding to a frame having a slightly curved mask surface. The flat face cathode ray tube has a remarkable effect of greatly reducing random reflection of illumination light or the like and moderating fatigue of eyes.

For the shadow mask material adapted in the existent system as described above, it has been attached an importance, for example, to press moldability and shape retainability keeping the shape upon pressing as it is so as to be attached by welding to a frame having a slightly curved mask surface.

However, when the flattening for the cathode-ray tube is advanced further in the shadow mask system, it may be a worry that the flattening can not be attained with a slightly curved mask surface adopted in existent cathode ray tubes.

In view of the above, it has been demanded for the development of a shadow mask material capable of completely flattening the mask surface in a shadow mask type cathode ray tube known so far and capable of coping therewith.

A subject of this invention is to provide a shadow mask material for use in a color picture tube capable of coping with a completely flat face cathode ray tube as described above, a shadow mask, and a color picture tube incorporating the same and, further, a shadow mask material for use in a color picture tube having excellent tensile strength and high temperature creep strength, a shadow mask and a color picture tube incorporating the same.

DISCLOSURE OF THE INVENTION

A shadow mask material for use in a color picture tube according to the invention is characterized by comprising a low carbon steel containing from 0.05 to 2.5% by weight of Cu and from 0.001 to 0.4% by weight of P.

A shadow mask material according to the invention is characterized by comprising a low carbon steel containing from 0.05 to 2.5% by weight of Cu, from 0.001 to 0.4% by weight of P and from 0.01 to 1.75% by weight of Ni.

A shadow mask material according to the invention is characterized by comprising a low carbon steel containing from 0.05 to 2.5% by weight of Cu and from 0.001 to 0.4%by weight of P.

A shadow mask for use in a color picture tube according to the invention is characterized by comprising a low carbon steel containing from 0.05 to 2.5% by weight of Cu, from 0.001 to 0.4% by weight of P and from 0.01 to 1.75% by weight of Ni.

A color picture tube according to the invention is characterized by incorporating a shadow mask for use in a color picture tube comprising a low carbon steel containing from 0.05 to 2.5% by weight of Cu and from 0.001 to 0.4% by weight of P.

A color picture tube according to the invention is characterized by incorporating a shadow mask for use in a color picture tube comprising a low carbon steel containing from 0.05 to 2.5% by weight of Cu, from 0.001 to 0.4% by weight of P and from 0.01 to 1.75% by weight of Ni.

A color picture tube according to the invention is characterized in that a shadow mask applied with tension is attached to a frame. The tension in the picture tube is desirably in either upper or lower direction or in both directions of the frame.

A shadow mask material according to the invention is characterized in that elongation is 0.1% or less when applied with a load stress of 20 kgf/mm$^2$ and kept at 450° C.×60 min.

BEST MODE FOR PRACTICING THE INVENTION

The shadow mask material according to this invention is welded to a frame in a state loaded with a large tension in the vertical direction and has a sufficient creep strength also at a high temperature such that the shadow mask applied with tension is kept in a tension—loaded state with no slacking of the shadow mask also in the subsequent heat treatment step.

Accordingly, extremely low carbon steel used as the material for the shadow mask according to this invention is preferably decarbonized and denitrated using a vacuum degasing method to reduce carbide and nitrides in the steel and promoted for the growth of the crystal grains in the steps of hot rolling or hot rolling and heat treatment (primary heat treatment and secondary heat treatment)

At first, the elements to be added to the steel used for the material of the shadow mask according to this invention and the reason for limiting the addition amount thereof are to be explained.

Referring to C, it is desirably as low as possible since carbides increase to hinder the growth of crystal grains as amount C in steel sheets after cold rolling is more. Therefore, the upper limit for the C content is preferably 0.01% by weight. The lower limit is preferably as low as possible providing that it can be reduced practically by a vacuum degasing treatment.

With reference to Mn, Mn has to be added for bonding with S in the steel to fix the S content in the steel as MnS to prevent hot shortness but lesser addition amount is preferred for improving the magnetic property and it is added by an amount of 0.5% by weight or less.

Si is preferably as less as possible since it deteriorates the adhesion of blackened film and the content is defined to 0.3% by weight or less. Since S greatly hinders the etching property, it is preferably as less as possible and the content is defined as 0.05% by weight or less. Further, since also N forms nitrides to hinder the growth of crystal grains, it is preferred as less as possible and restricted to 0.05% by weight or less.

Regarding Cu, it has an effect of increasing the precipitation amount of $\epsilon$-phase in the precipitation heat treatment (secondary heat treatment) along with increase of the addition amount to greatly improve the yield strength, tensile strength and creep strength. However, no sufficient effect for the improvement of the strength can be obtained when the addition amount is insufficient. It is preferably, 0.05% by weight or more, more preferably, 0.5% by weight or more and, further preferably, 1% by weight or more.

On the other hand, if the addition amount is excessive, precipitates are increased and deteriorates the mechanical property such as tensile strength and creep strength. It is preferably 2.5% by weight or less, more preferably, 2% by weight or less and, further preferably 1.5% by weight or less.

P is effective for increasing the strength by solid solution strengthening and since the tensile strength and the creep strength increase remarkably by the addition amount of P, solid solution strengthening by P can be combined with strengthening based on the precipitation heat treatment by the addition of Cu as an object of this invention.

The amount of P added is preferably 0.001% or more, more preferably, 0.01% by weight or more and, further preferably, 0.1% by weight or more.

When the addition amount is excessive, mixed grains are formed by segregation and this also results in embrittlement, it is preferably 0.4% by weight or less, more preferably, 0.25% by weight or less and, further preferably, 0.15% by weight or less.

Ni has a remarkable effect of preventing hot shortness caused by the addition of Cu and has a great effect of improving the yield in the manufacturing step for the shadow mask material applied with tension in accordance with this invention. Further, quality can be stabilized since this suppresses segregation of Cu and tensile strength and creep strength are improved by solid solution hardening of Ni. Since the effect of Ni can be attained sufficiently by the addition amount about ⅔ or less of the addition amount of Cu, it is preferably within a range from 0.01 to 1.75% by weight. More preferably, it is within a range from 0.1 to 0.8% by weight.

If the addition amount is less than 0.01% by weight, the effect is not distinctive since the amount is too small and, on the other hand, effect of addition is no more remarkable if it exceeds 1.75% by weight.

Further, it is more preferably that the addition amount is about ½ of the Cu addition amount.

In this invention, a shadow mask material of extremely high tensile strength could be developed by precipitating a ultra-fine Cu phase (ϵ-phase) on the nanometer (nm) order by precipitation heat treatment (secondary heat treatment) in the Cu-added ultra-low carbon steel and further adding P to utilize the solid solution strengthening of P together.

Then, the method of manufacturing a thin steel sheet as a shadow mask material according to this invention is to be explained. After hot rolling the ultra-low steel carbon containing the chemical ingredients described above prepared by melting by using a vacuum melting or vacuum degasing method, it is pickled to remove oxide layers formed in the hot rolling step. Successively, it is cold rolled into a sheet thickness of 0.02 to 0.3 mm. Then, a precipitation heat treatment (secondary heat treatment) is applied for 10 min to 20 hours in a temperature region from 300 to 700° C. When the addition amount of Cu or Cu and P is large, since the recrystallizing temperature increases, the precipitation heat treatment may be practiced near 700° C. at the upper limit but the precipitation heat treatment is preferably applied in a temperature range from 450 to 700° C. in view of precipitation of Cu and grain size of precipitates. If the temperature for the precipitation heat treatment is lower than 300° C., the ϵ-phase is not precipitated sufficiently and no required tensile strength can be obtained. On the other hand, when the precipitation heat treatment is applied in a temperature region exceeding 700° C., it causes over precipitation to make the ϵ-phase coarse, or the ϵ-phase is re-solid solubilized in the steel to lower the tensile strength. The precipitation heat treatment may be applied by using either a pack annealing furnace or continuous annealing furnace depending on the heating temperature and the heating time.

Further, as another embodiment, the extremely low carbon steel described above may be hot rolled and pickled and then cold rolled into a sheet thickness of 0.1 to 0.6 mm and then applied with intermediate annealing (primary heat treatment) in a temperature region from 500 to 800° C. to condition the crystal grain size and, subsequently, applied with secondary cold rolling into a final sheet thickness of 0.02 to 0.3 mm and then the precipitation heat treatment described above (secondary heat treatment) may be applied. When the temperature for the intermediate annealing is lower than 500° C., softening is not sufficient and the tensile strength increases extremely when the precipitation heat treatment described above is applied after the secondary cold rolling. On the other hand, when the annealing temperature exceeds 800° C., no desired tensile strength can be obtained even when the precipitation heat treatment is applied after the secondary cold rolling.

EXAMPLE

This invention is to be explained more specifically by way of examples. Table 1 shows chemical compositions and crack occurrence rate upon hot rolling when slabs formed by melting steels (A-N) having 14 kinds of chemical compositions by vacuum degassing and formed into 2.5 mm hot rolled steel sheets. After pickling the hot rolled steel sheets with sulfuric acid, they were cold rolled into two types of cold rolled steel sheets with sheet thickness of 0.1 mm and 0.3 mm. Subsequently, the cold rolled steel sheets of 0.1 mm thickness were directly applied with secondary heat treatment (precipitation heat treatment) and the cold rolled steel sheets of 0.3 mm thickness were applied with a primary heat treatment (intermediate annealing) and, after put to secondary cold rolling into a steel sheet thickness of 0.1 mm, applied with a secondary heat treatment (precipitation heat treatment). Characteristic test was conducted on the thus obtained test materials. The tensile strength was measured by a tensile tester and the creep strength was measured by using a creep tester (manufactured by Tokai Seisakusho) and elongation (%) when kept in an atmospheric air at 450° C.×60 min under a load stress of 20 kgf/mm2 was measured and evaluated. The evaluation for the creep strength is determined by the following standards.

That is, in a case of applying a heat treatment for blackening after welding the shadow mask to a frame, since it is necessary that the shadow mask in a state applied with tension after blackening is kept in a state loaded with tension without slacking, it is determined considering that the heat treatment is applied at a low temperature, for example, about 60 min at 450° C., which is lower than the recrystallization temperature of steel.

Further, when the shadow mask of this invention is welded to a frame in a state loaded with a large vertical tension, the elongation upon loading the tensile stress of 20 kgf/mm$^2$ is desirably 0.1% or less and this is determined as a standard value for the creep strength considering this.

TABLE 1

Chemical composition for test material (steel sheet)

| Specimen | Chemical composition (wt %) | | | | | | | | | |
|---|---|---|---|---|---|---|---|---|---|---|
| No. | C | Mn | Si | S | N | Cu | P | Ni | Fe | section |
| A | 0.005 | 0.43 | 0.01 | 0.01 | 0.002 | 0.05 | 0.14 | 0.007 | balance | Claim1 |
| B | 0.004 | 0.45 | 0.01 | 0.01 | 0.002 | 0.07 | 0.001 | 0.006 | balance | Claim1 |
| C | 0.006 | 0.46 | 0.01 | 0.01 | 0.002 | 0.05 | 0.150 | 0.007 | balance | Claim1 |
| D | 0.005 | 0.47 | 0.02 | 0.01 | 0.002 | 0.05 | 0.152 | 0.024 | balance | Claim2 |
| E | 0.007 | 0.45 | 0.01 | 0.01 | 0.002 | 1.61 | 0.0012 | 0.008 | balance | Claim2 |
| F | 0.004 | 0.44 | 0.01 | 0.01 | 0.002 | 1.55 | 0.159 | 0.78 | balance | Claim2 |
| G | 0.006 | 0.46 | 0.01 | 0.01 | 0.002 | 2.45 | 0.001 | 0.008 | balance | Claim1 |
| H | 0.006 | 0.47 | 0.01 | 0.01 | 0.002 | 2.44 | 0.147 | 0.008 | balance | Claim1 |
| I | 0.005 | 0.46 | 0.01 | 0.01 | 0.002 | 2.44 | 0.155 | 1.25 | balance | Claim2 |
| J | 0.006 | 0.45 | 0.01 | 0.01 | 0.002 | 2.49 | 0.387 | 1.38 | balance | Claim2 |
| K | 0.007 | 0.44 | 0.01 | 0.01 | 0.002 | 2.49 | 0.358 | 1.75 | balance | Claim2 |
| L | 0.005 | 0.44 | 0.01 | 0.01 | 0.002 | 2.5 | 0.001 | 0.007 | balance | Claim1 |
| M | 0.006 | 0.46 | 0.01 | 0.01 | 0.002 | 2.5 | 0.17 | 1.3 | balance | Claim2 |
| N | 0.005 | 0.44 | 0.01 | 0.01 | 0.002 | 2.5 | 0.4 | 1.3 | balance | Claim2 |

Table 2 shows the characteristics of the test materials.

TABLE 2

| Specimen No. | Tensile strength ($Kgf/mm^2$) | Creep elongation (%) |
|---|---|---|
| A | 77 | 0.14 |
| B | 72 | 0.16 |
| C | 82 | 0.09 |
| D | 83 | 0.08 |
| E | 75 | 0.09 |
| F | 91 | 0.04 |
| G | 78 | 0.12 |
| H | 87 | 0.05 |
| I | 86 | 0.04 |
| J | 92 | 0.03 |
| K | 92 | 0.03 |
| L | 84 | 0.04 |
| M | 88 | 0.03 |
| N | 92 | 0.03 |

While explanation has been made in one vertical direction relative to the shadow mask, the shadow mask material according to this invention can fully provide the function also to a shadow mask applied with constant tension from two vertical and horizontal directions.

Industrial Applicability

Since the shadow mask material according to this invention has excellent tensile strength and creep strength, it has an effect that the shadow mask does not deform even when heat treatment for blackening is applied after being welded to a frame.

What is claimed is:

1. A shadow mask material for use in a color picture tube comprising a low carbon steel containing from 0.05 to 2.5% by weight of Cu, and from 0.001 to 0.4% by weight of P, from 0.01 to 1.75% by weight of Ni, 0.01% by weight or less of C, 0.5% by weight or less of Mn, 0.05% by weight or less of Si and 0.05% by weight of N.

2. A shadow mask for use in a color picture tube comprising a low carbon steel containing from 0.05 to 2.5% by weight of Cu from 0.001 to 0.4% by weight of P, from 0.01 to 1.75% by weight of Ni, 0.01% by weight or less of C, 0.5% by weight or less of Mn, 0.05% by weight or less of Si and 0.05% by weight of N.

3. A color picture tube incorporated with a shadow mask for use in a color picture tube, comprising a low carbon steel containing from 0.05 to 2.5% by weight of Cu, and from 0.001 to 0.4% by weight of P, from 0.01 to 1.75% by weight of Ni, 0.01% by weight or less of C, 0.5% by weight or less of Mn, 0.05% by weight or less of Si and 0.05% by weight of N.

4. A picture tube in which a shadow mask applied with tension is attached to a frame, wherein a shadow mask comprising a low carbon steel containing from 0.05 to 2.5% by weight of Cu, from 0.001 to 0.4% by weight of P, from 0.01 to 1.75% by weight of Ni, 0.01% by weight or less of C, 0.5% by weight or less of Mn, 0.05% by weight or less of Si and 0.05% by weight of N.

5. A picture tube as defined in claim 4, wherein the tension is applied in either or both of upper and lower directions of a frame.

6. A shadow mask material having an elongation of 0.1% or less when it is kept at 450° C.×60 min under a load stress of 20 $kgf/mm^2$, wherein a shadow mask material comprising a low carbon steel containing from 0.05 to 2.5% by weight of Cu, from 0.001 to 0.4% by weight of P, from 0.01 to 1.75% by weight of Ni, 0.01% by weight or less of C, 0.5% by weight or less of Mn, 0.05% by weight or less of Si and 0.05% by weight of N.

* * * * *